US012053043B2

(12) United States Patent
Smith

(10) Patent No.: US 12,053,043 B2
(45) **Date of Patent: *Aug. 6, 2024**

(54) HAND-TIED HAIR WEFT

(71) Applicant: Covet and Mane LLC, MontClair, NJ (US)

(72) Inventor: Dafina Smith, Montclair, NJ (US)

(73) Assignee: Covet and Mane LLC, Montclair, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/183,887

(22) Filed: Mar. 14, 2023

(65) Prior Publication Data

US 2023/0218029 A1 Jul. 13, 2023

Related U.S. Application Data

(63) Continuation of application No. 16/888,670, filed on May 30, 2020, now Pat. No. 11,653,708.

(60) Provisional application No. 62/968,571, filed on Jan. 31, 2020.

(51) Int. Cl.
*A41G 5/00* (2006.01)

(52) U.S. Cl.
CPC ..... *A41G 5/0046* (2013.01)

(58) Field of Classification Search
CPC ..... A41G 5/00; A41G 5/002; A41G 5/0026; A41G 5/0046; A41G 5/004; A41G 5/0053; A41G 5/006; A41G 5/0073
See application file for complete search history.

(56) References Cited

U.S. PATENT DOCUMENTS 4,600,029 A * 7/1986 Ueberschaar ..... A41G 3/00 132/53
2020/0245706 A1* 8/2020 Durand ..... A41G 5/0046

OTHER PUBLICATIONS

Office Action Response in related Canada Application No. 3166488, dated Mar. 15, 2023, 25 pages.
Office Action Response in related China Application No. 2020800952944, dated Apr. 11, 2023, 6 pages.
Office Action Response in related China Application No. 2020800952944, dated Jul. 11, 2023, 6 pages.

* cited by examiner

*Primary Examiner* — Rachel R Steitz
(74) *Attorney, Agent, or Firm* — Thompson Patent Law

(57) ABSTRACT

Apparatus and associated methods relate to a hand-tied hair weft having at least two hair bundles fixed to three or more thread-like filaments that provide a cortex, where each two adjacent hair bundles are separated by one or more knots formed by the three or more thread-like filaments. In an illustrative example, the two adjacent hair bundles may be separated by, for example, at least two knots. The knots may include overhand knots. By introducing one or one or more knots, the width of the hand-tied hair weft may be customized without the weft shedding or unraveling.

14 Claims, 8 Drawing Sheets

HAND-TIED HAIR WEFT

CROSS-REFERENCE TO RELATED APPLICATIONS

This application is a continuation of U.S. patent application Ser. No. 16/888,670, titled "Hand-Tied Hair Weft," filed by Dafina Smith, on May 30, 2020, which claims the benefit of U.S. Provisional Application Ser. No. 62/968,571, titled "Hand-Tied Hair Weft," filed by Dafina Smith, on Jan. 31, 2020.

This application incorporates the entire contents of the foregoing application(s) herein by reference.

TECHNICAL FIELD

Various embodiments relate generally to hand-tied hair wefts.

BACKGROUND

One of the most attractive features of people, especially women, has always been their hair. This fact has been known for thousands of years, which explains certain religious sects' edict to cover or even cut women's hair. For those women who are unaffected by such restrictions, however, long, luxurious human hair is an asset that results in improved appearance and self-esteem. Unfortunately, due to age, disease, or genetics, not everyone is fortunate enough to have a full complement of natural hair.

Numerous methods and devices have been developed to create the appearance of thicker or longer hair. When adding supplemental natural or synthetic hair (e.g., a weft hair extension) to that of an individual, a typical method involves applying the supplemental hair directly to the individual's natural hair, either by gluing the strands of hair to the natural hair or by bonding strands of the supplemental hair to the natural hair using a durable bonding material. Applying additional hair strands to an individual's natural hair is a meticulous process that requires hours of application time. Additionally, after time, the supplemental hair strands tend to unravel or fall out. An alternate method of providing hair extensions for a user involves adding to an individual's natural hair by using hair clips to attach strands of supplemental hair to the user's natural hair.

A hair weft is a collection, or bundle, of strands of hair that are fixed onto a seam which has a proximal end and a distal end. The weft is then sewn, clipped or otherwise attached onto a person's natural hair. Hair wefts are used by hair salon professionals to enhance a person's natural hair that may be thin, short, or have an undesired shape or texture. Hair wefts are generally used by experienced stylists and other salon professionals to add volume and length to a person's existing hair.

Stylists seek to achieve the most sleek and seamless look between a person's naturally existing hair and the hair wefts being added by the stylist. The desired look is that the hair weft being applied by the stylist blends in with a person's natural hair and therefore is unobservable to the naked eye. Hair wefts made from human hair, as opposed to synthetic hair, blend most naturally with a person's existing hair.

Hair wefts can be made of human hair and hand-tied into wefts by an artisan. Alternatively, hair wefts can be synthetic and mass produced on machinery. One way to achieve the desired look of a seamless blend between a person's natural hair and the hair wefts added by the stylist to enhance or extend that person's hair is to use a hair weft made from human hair and hand-tied into wefts by artisans. Hand-tied hair wefts made of human hair have a more silky, smooth appearance than machine-wefted hair, which tends to be coarse, bulky and unnatural looking.

Hand-tied hair wefts are manufactured and sold according to weight measured in grams, with the thinnest, lightest weighted wefts being most desirable to create a sleek, natural look. Also, when hair wefts are more lightweight, they can deliver at least twice the density of hair and provide the same weft-seam thinness. This allows stylists to use fewer wefts per row to apply to a person's head, which makes the application process faster, easier, and cheaper and thus more desirable. Hair wefts are purchased individually by unit.

A weft hair extension may be attached to a user using micro rings, microbeads, clamping, braiding, tying, bonding, tape, glue, or by sewing to the user's hair. For example, a section of user's hair may be held together close to the user's scalp by a double-sided tape, and a weft hair extension may be attached to one side of the tape. Subsequently, the weft hair extension and the attached hair are pulled upwards and another weft extension may be attached on the other side of the tape. A weft hair extension may also be sewn to user's hair.

Current use of hand-tied hair wefts involves several shortcomings. In particular, because they were made from human hair and hand tied by an artisan, the hand-tied hair wefts were very delicate and lacked the durability and flexibility of machine-wefted hair. Thus, a consumer would be required to spend more time and money to have hair extensions replaced more frequently to maintain the desired look and feel of natural hair. Also, hand-tied hair wefts made with a predetermined, standard width were difficult for salon professionals to affix to a person's natural hair because the wefts came in a pre-determined size that did not account for the different sizes of a client's head. To apply existing hair wefts, hair stylists would have to arbitrarily cut each delicate hand-tied weft that they used in order to match it to the size of each client's head. Upon doing so, the hand-tied hair weft would shed and unravel, thereby rendering it compromised, which resulted in the hair weft often going to waste. Stylists would then be forced to buy more hair weft units than they might otherwise need to achieve the desired look, which increased the costs to both the salon and the consumer.

Some hair stylists try to solve the problem with existing wefts by folding a hair weft over onto itself, but this makes the weft bulky and thus does not achieve the sleek, seamless blend that the salon professional and consumer may be trying to achieve. Some stylists use nail glue and Krazy Glue on their clients' heads when applying wefts that could not be customized to the size of their clients' heads so that the delicate weft would not shed or unravel when it was sized to a client's head. This did not solve the problem with existing hair wefts because the glue made the hair bulky and thus did not achieve the natural, sleek blend between a person's natural hair and the hair weft that was trying to be achieved. Additionally, glue loses its adhesiveness quickly, which would also cause the hair weft to unravel and fall out shortly after it had been affixed to a client's head, so that approach lacked durability.

SUMMARY

Apparatus and associated methods relate to a hand-tied hair weft having at least two hair bundles fixed to three or more thread-like filaments that provide a cortex, where each two adjacent hair bundles are separated by one or more knots formed by the three or more thread-like filaments. In an illustrative example, the two adjacent hair bundles may be separated by, for example, at least two knots. The knots may include overhand knots. By introducing one or one or more knots, the width of the hand-tied hair weft may be customized without the weft shedding or unraveling.

Some embodiments may include a knot or series of knots placed, for example, on the seam, or cortex, at predetermined specific, measurable intervals (e.g., lengths). Each end of the wefts may already be finished off securely with a knot, in some examples. Some implementations may further include one or more additional knots to establish "cut points" between the proximal end and a distal end of the seam of the pre-sized human hair weft.

Various embodiments may provide exemplary Hand-Tied Hair Extension with Cut-Point Wefts (HTHECPW). In an illustrative example, an HTHECPW may be created on a loom by an artisan manipulating strands of human hair into a weft that has a seam with one proximal end and one distal end. The HTHECPW may be custom designed to include multiple secure cut points at predetermined specific lengths between the proximal and distal ends of the seam. Some examples of the HTHECPW may advantageously allow hair stylists cut the weft at a pre-determined location (e.g., between two predetermined adjacent secure cut points created by adding knots) to customize the width of the HTHECPW to a person's head without the weft shedding or unraveling as a result. These secure points of knots may be arranged along a cortex formed from several strands of hair. By way of example and not limitation, the Hand-Tied Hair Extension with Cut-Point Wefts may include two, three, six or up to at least twelve secure points, for example, to isolate hair bundles.

Various embodiments may achieve one or more further advantages. For example, some HTHECPW embodiments may simplify, for the stylist, operations to customize a length of the HTHECPW to a person's head and thus create the flawless, natural look clients look for with hair extensions. Some HTHECPW with secure cut points may also be more durable than hand-tied hair wefts that have to be cut by the salon professional randomly between the proximal and distal ends of the weft and then glued or folded over the weft to try to customize it to the size of a particular client's head. The HTHECPW may, in various examples, not only look better, but last longer. This may advantageously benefit the consumer because they need to make fewer visits to hair professionals to have their hair extensions removed and replaced by a salon professional, which can be costly. Furthermore, salon professionals may employ various embodiments of the HTHECPW to provide, for example, multiple places to cut delicate hand-tied hair wefts made of human hair in order to customize them to the differing sizes of their clients' heads without the unraveling, shedding or waste that previously occurred when they used hand-tied hair wefts without cut points.

Various embodiments may achieve one or more further advantages. For example, some embodiments may use a loom machine to form the hand-tied hair weft. A number of poles may be configured to stretch the thread-like filaments. A worker may manipulate one of the poles to form the knots easily and quickly. In some embodiments, the hand-tied hair weft may enable a person such as a hairstylist to customize the width of the hand-tied hair weft when applying the hand-tied hair weft on a wearer's head. When two adjacent hair bundles are separated by two or more knots, a hairstylist may cut between two knots to make the original hand-tied hair weft into two pieces without wasting any hair in the original hand-tied hair weft. As no chemicals (e.g., glue) would be used to prevent the weft from shedding or unraveling, a less hyposensitized hand-tied hair weft may be advantageously provided.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1A:
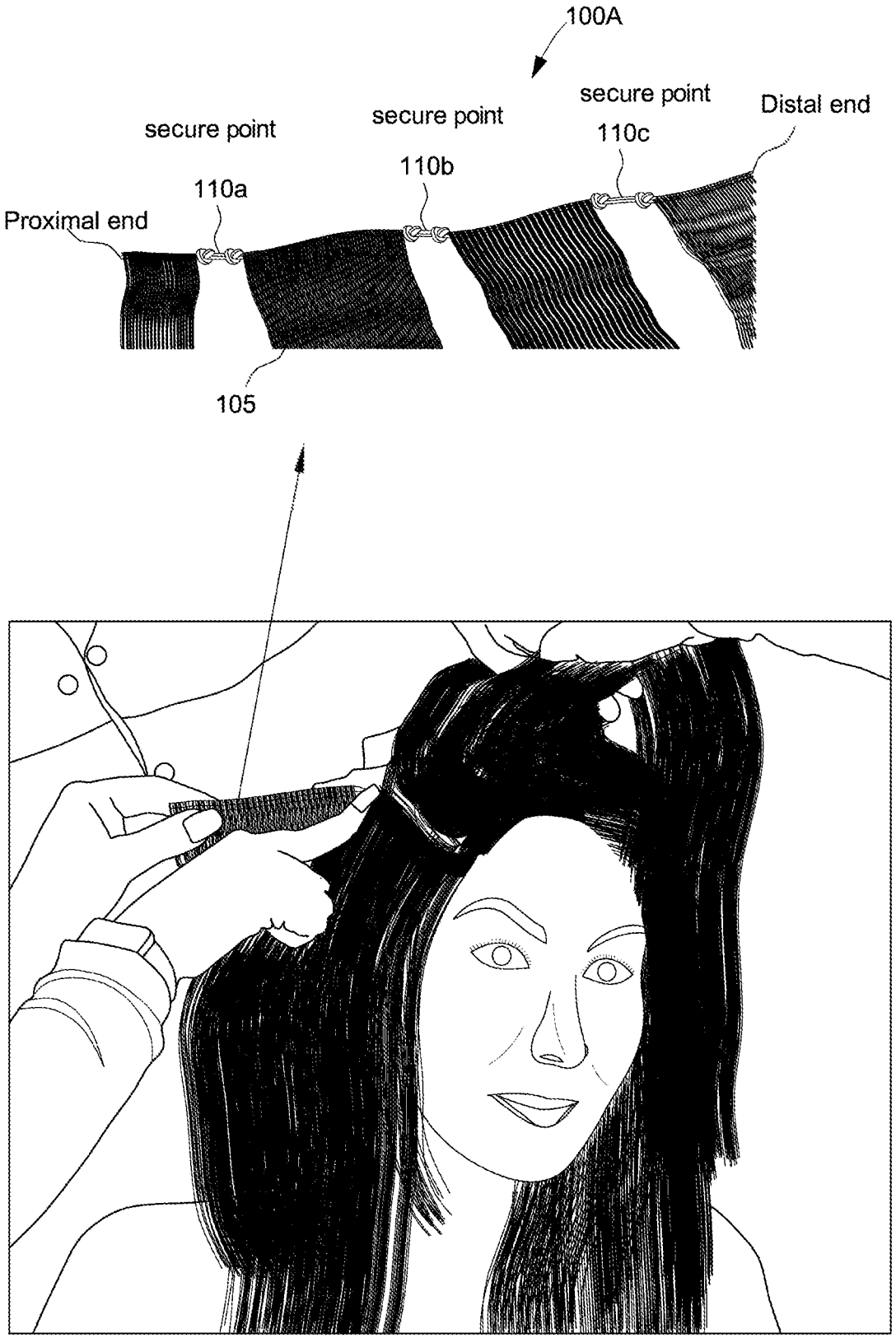
FIG. 1A depicts an exemplary hand-tied hair weft.

FIG. 1A depicts an exemplary hand-tied hair weft. Hand-tied hair wefts may be used to enhance thin and/or short natural hair. A hand-tied hair weft is created by an artisan who manipulates, for example, three strings (e.g., thread) on a loom. The three strings may form a cortex extending width-wise to define a width of the weft. From this cortex, strands of hair may be individually suspended by tying the strands to the strings of the cortex, for example. In various implementations, a number of closely spaced hair strands may be adjacently distributed along the cortex to form segments or bundled sections. Between adjacent bundle sections may be formed a secure point, according to various embodiments, examples of which are described herein. In the depicted figure, the exemplary hand-tied hair weft may enable a person such as a hairstylist to customize the width of the hand-tied hair weft when applying the hand-tied hair weft on a wearer's head. An exemplary hand-tied hair weft 100A is designed to have multiple secure points such that the hairstylist may adjust a size of the weft by cutting at a predetermined location (e.g., between two predetermined adjacent secure points) so as to customize the width of the hand-tied hair weft without the weft shedding or unraveling.

In this depicted example, the exemplary hand-tied hair weft 100A includes a number of strands of hair 105 fixed on a number of laterally extending threads that form the cortex. The threads include a proximal end and a distal end. The width of the hand-tied hair weft may refer to the distance between the proximal end and the distal end of the threads. The hand-tied hair weft 100A also includes a number of secure points (e.g., knots, nodes, small amount of glue, or a small clip) arranged on the threads between several strands of hair. For example, a secure point may be formed predetermined intervals (e.g., every thirty or sixty strands of hair). Every thirty or sixty strands may be called a bundle (e.g., the bundle ma be arranged between two secure points). The hairstylist may cut anywhere on the threads to tailor the hand-tied hair weft. In this depicted example, three secure points 110*a*, 110*b*, and 110*c* are shown in FIG. 1A. If the hairstylist cuts the hand-tied hair weft 100A between the first secure point 110*a* and the second secure point 110*b*, only the hair between the first secure point 110*a* and the second secure point 110*b* may shed or potentially unravel from the hand-tied hair weft 100A, the rest of the hair in the hand-tied hair weft 100A would not be affected. In some embodiments, the bundle cut by the hairstylist may be maintained while substantially or entirely eliminating unraveling.

In some embodiments, the hand-tied hair weft 100A may include one or more secure points. For example, the hand-tied hair weft 100A may include, for example, two, three, six, ten, twelve or more secure points. The number and the locations of the one or more secure points may be decided depending on, for example, the width of the hair weft 100A.

In some examples, the distribution of the secure points may be at a linear density along the cortex as an inverse function, for example, with respect to an absolute distance from a closest one of the distal or proximal ends of the cortex. In such embodiments, a hair stylist may have customize the width of a hair weft with higher resolution, while retaining substantial symmetry as the stylist may customize the width by cutting a similar number of bundles from each of the proximal and the distal ends.

In some examples, the length of each bundle (e.g., corresponding to distance between consecutive secure points) may increase with distance from one of the proximal or distal ends of the cortex. Such embodiments may facilitate a single cut from one end having a high resolution associated with the relatively close proximity of the secure points at the end to be cut.

Figure 1B:
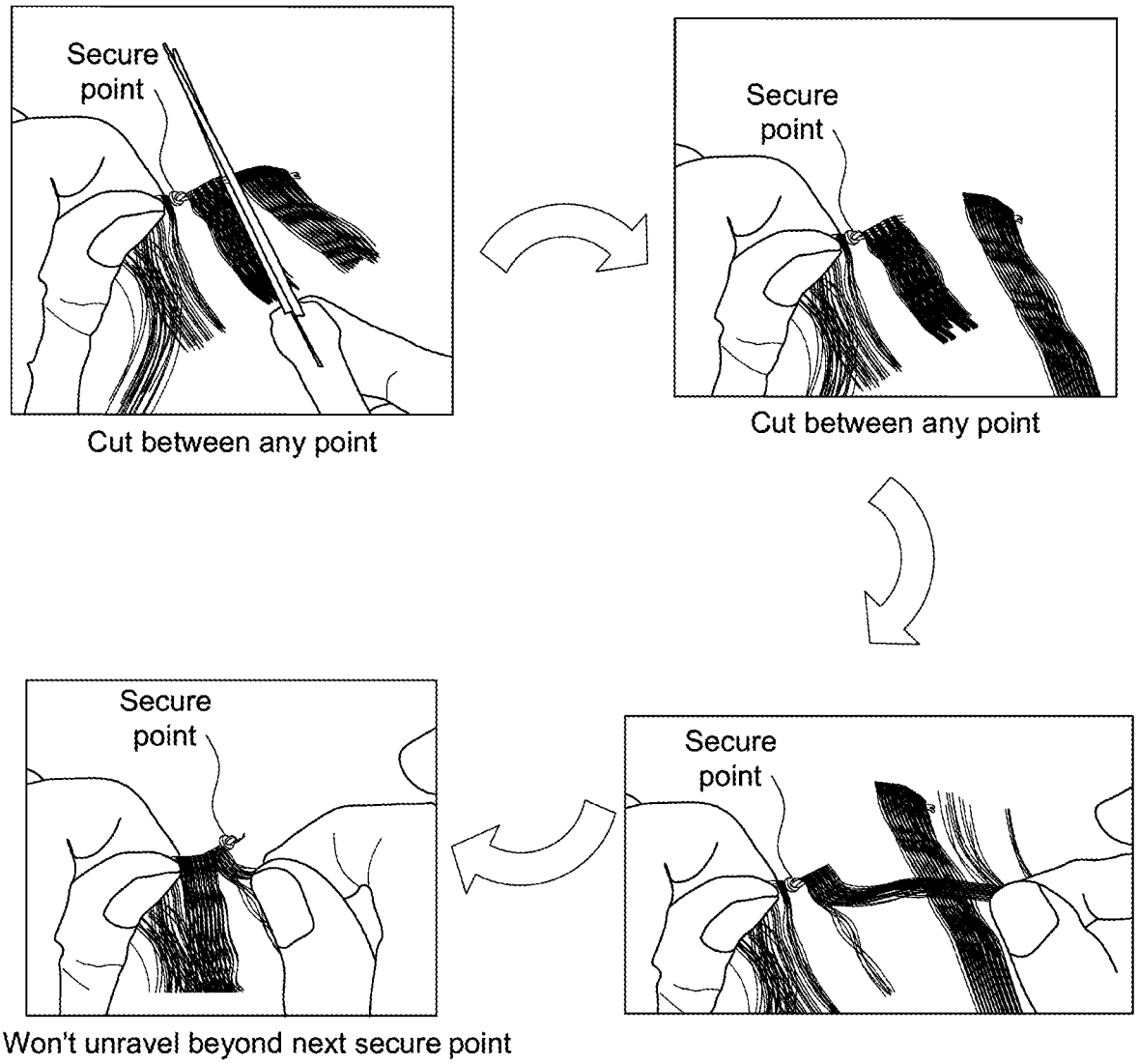
FIG. 1B depicts an exemplary sequential process for tailoring the exemplary hand-tied hair weft.

FIG. 1B depicts an exemplary sequential process for tailoring the exemplary hand-tied hair weft. In this depicted example, the hairstylist holds the proximal end of the hand-tied hair weft 100A and then uses, for example, a scissors cutting the hand-tied hair weft between, for example, a preselected secure point and the distal end of the hand-tied hair weft. In some embodiments, the hairstylist may also cut the hand-tied hair weft between, for example, two adjacent secure points. As shown in the lower right side, the hair between the preselected secure point and the secure point may be taken off by the hairstylist. In contrast, the hair positioned between the proximal end and the preselected secure points may advantageously substantially reduce or prevent shedding or unraveling.

Figure 1C:
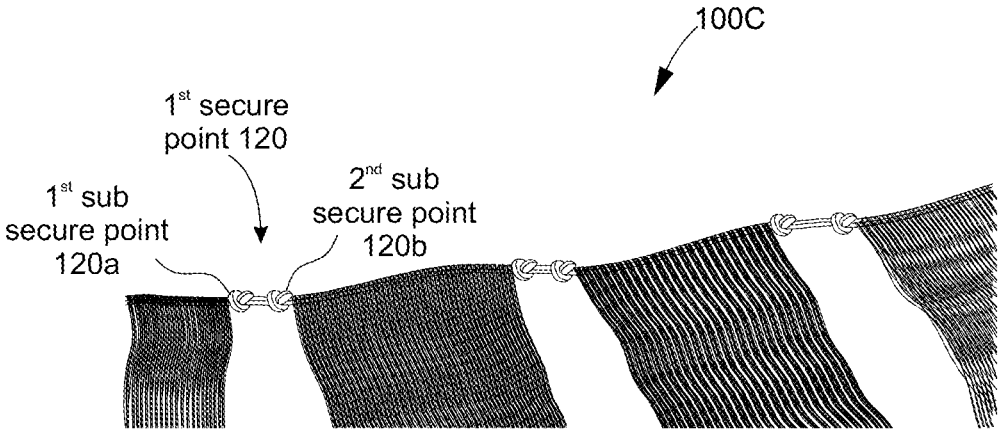
FIG. 1C depicts another exemplary hand-tied hair weft.

FIG. 1C depicts another exemplary hand-tied hair weft. In this depicted example, a hand-tied hair weft 100C also includes multiple secure points. Each secure point (e.g., the 1st secure point 120) includes two or more sub secure points (e.g., knots). For example, in this depicted example, the 1st secure point 120 includes two knots. The hairstylist may cut between the two knots 120*a* and 120*b* such that the cut portion may also be advantageously kept from unraveling. For example, when the width of a hand-tied hair weft is 10 inches, the hairstylist may cut it into two pieces without compromising some or all of the hair bundles or wasting any hair of the original hand-tied hair weft.

Figure 2:
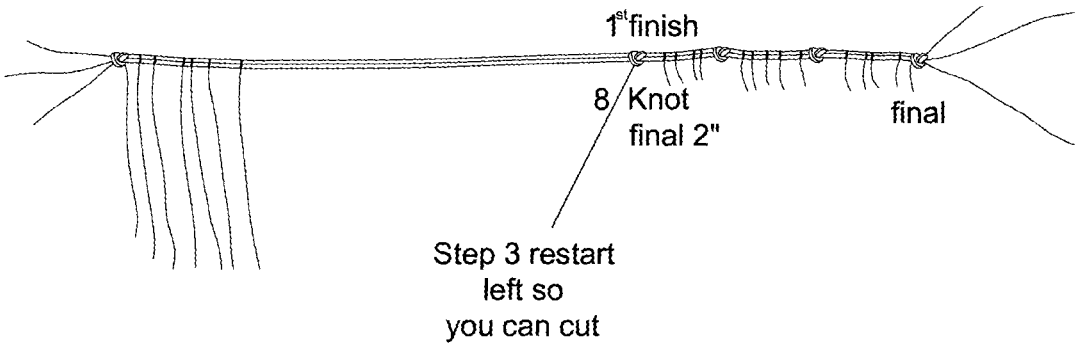
FIG. 2 depicts a first embodiment of the exemplary hand-tied hair weft.

FIG. 2 depicts a first embodiment of the exemplary hand-tied hair weft. In this depicted example, the hand-tied hair weft is formed on three threads. Multiple knots (e.g., two or more knots) may be formed on the threads to isolate different hair bundles. In some embodiments, the threads may include nylon threads.

Figure 3:
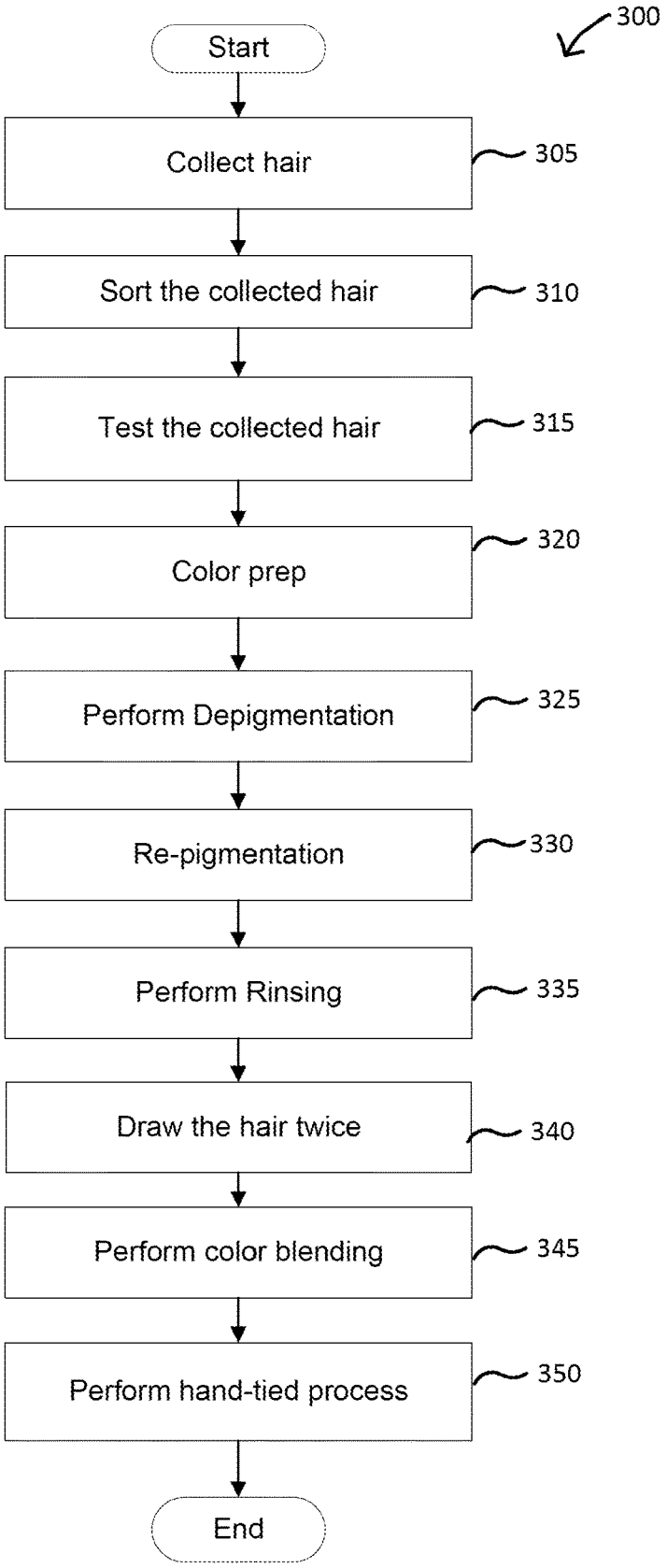
FIG. 3 depicts a flowchart of an exemplary method to generate the hand-tied hair weft.

FIG. 3 depicts a flowchart of an exemplary method to generate the hand-tied hair weft. An exemplary method 300 to form a hand-tied hair weft (e.g., the hand-tied hair weft 100A) includes, at 305, collecting hair and, at 310, sorting the collected hair. The hair may be sorted based on whether it has, for example, a blue or a red undertone to determine if it can be dyed, for example, blonde. The method 300 also includes, at 315, testing the hair. Every bundle may be tested to ensure it is virgin and that the hair cuticles remain substantially intact.

The method 300 also includes, at 320, performing color preparation. The cuticle may advantageously remain intact and aligned throughout the coloring process. The method 300 also includes, at 325, performing depigmentation. For example, the hair may undergo a slow and precise depigmentation process. The color may be lightened by an oxidation method to preserve cuticle integrity.

The method 300 also includes, at 330, performing re-pigmentation. During the re-pigmentation, a permanent textile dye that stains the cortex of the hair may be used to tenure the color longevity. The hair may be constantly agitated for thorough and even color saturation. The method 300 also includes, at 335, performing rinsing. Every bundle of hair may be washed, for example, more than 30 times. During cleansing and conditioning, treatments may be constantly reformatted to respond to seasonal changes. The hair may be smoothed before it is air-dried to allow for a silky fee without silicones or fillers.

The method 300 also includes, at 340, drawing the hair, for example, twice such that short hairs may be removed from every bundle, which may ensure that the hair is thick from root to tip. The method 300 also includes, at 345, performing color blending. The hair may be weighted and sorted for precisely customized color formulations. The method 300 also includes, at 350, performing a hand-tied process to form the hand-tied hair weft. A flowchart of an exemplary method to perform the hand-tied process is discussed in detail with reference to FIG. 4.

Figure 4:
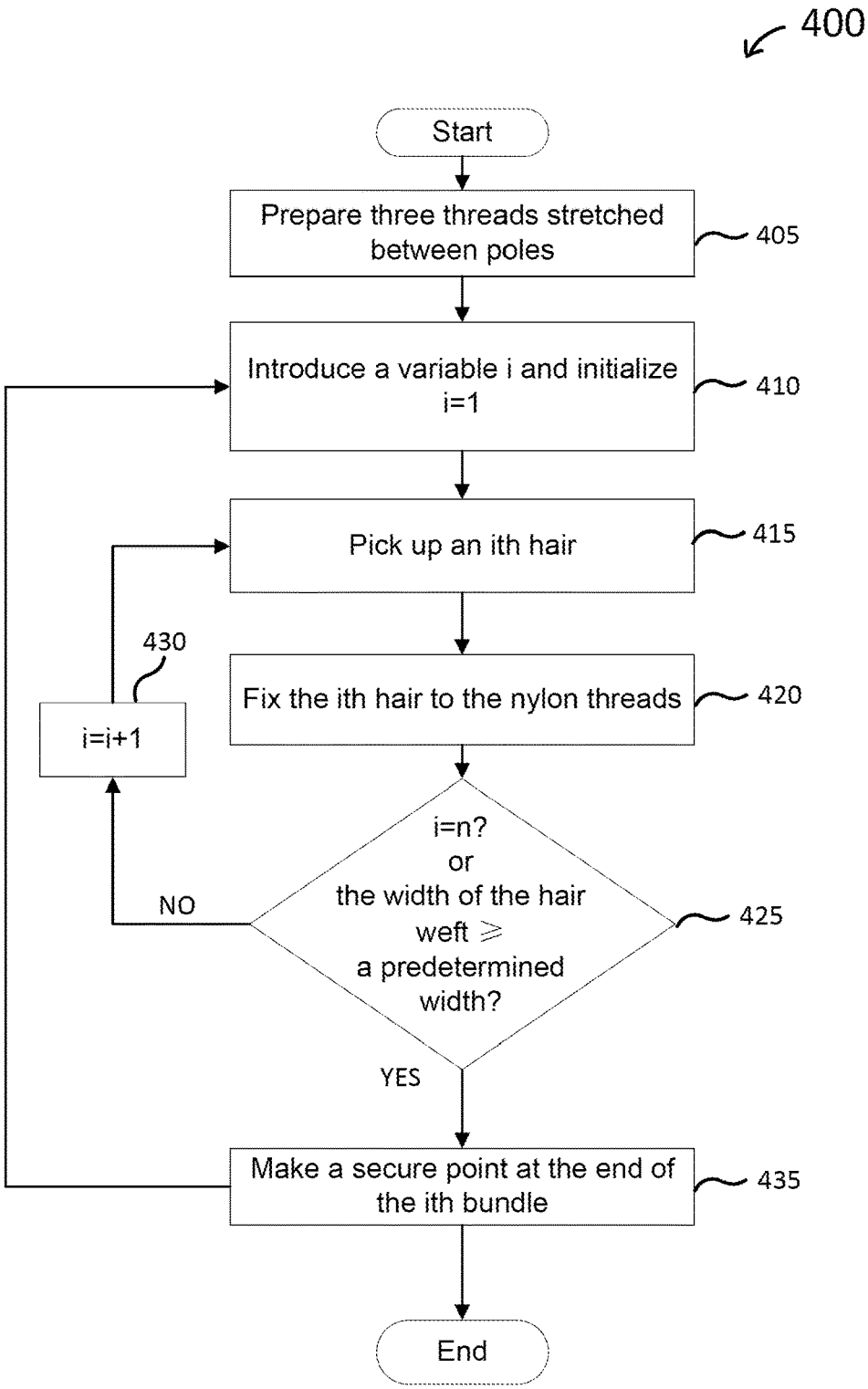
FIG. 4 depicts a flowchart of an exemplary method to perform the hand-tied process discussed with reference to FIG. 3.

FIG. 4 depicts a flowchart of an exemplary method to perform the hand-tied process discussed with reference to FIG. 3. A method 400 to perform the hand-tied process includes, at 405, preparing, for example, three threads stretched between a number of poles. In some embodiments, the number of the threads may be three or more threads. In some embodiments, the number of threads may be more than three. The method 400 also includes, at 410, introducing a variable i and initialize i=1. The method 400 also includes, at 415, picking up an ith hair and, at 420, fixing the ith hair to the stretched threads. The method 400 also includes, at 425, decides whether i is equal to a predetermined number n (e.g., n=50, 100, 200, 300, 500 hair) or whether the width of the fixed hair is greater than or equal to a predetermined width (e.g., a bundle). If not, then the method 400 also includes, at 430, incrementing the variable i, and the method loops back to 415. If yes, the method 400 also includes, at 435, making a secure point (e.g., a knot), and the method loops back to 410.

Figure 5:
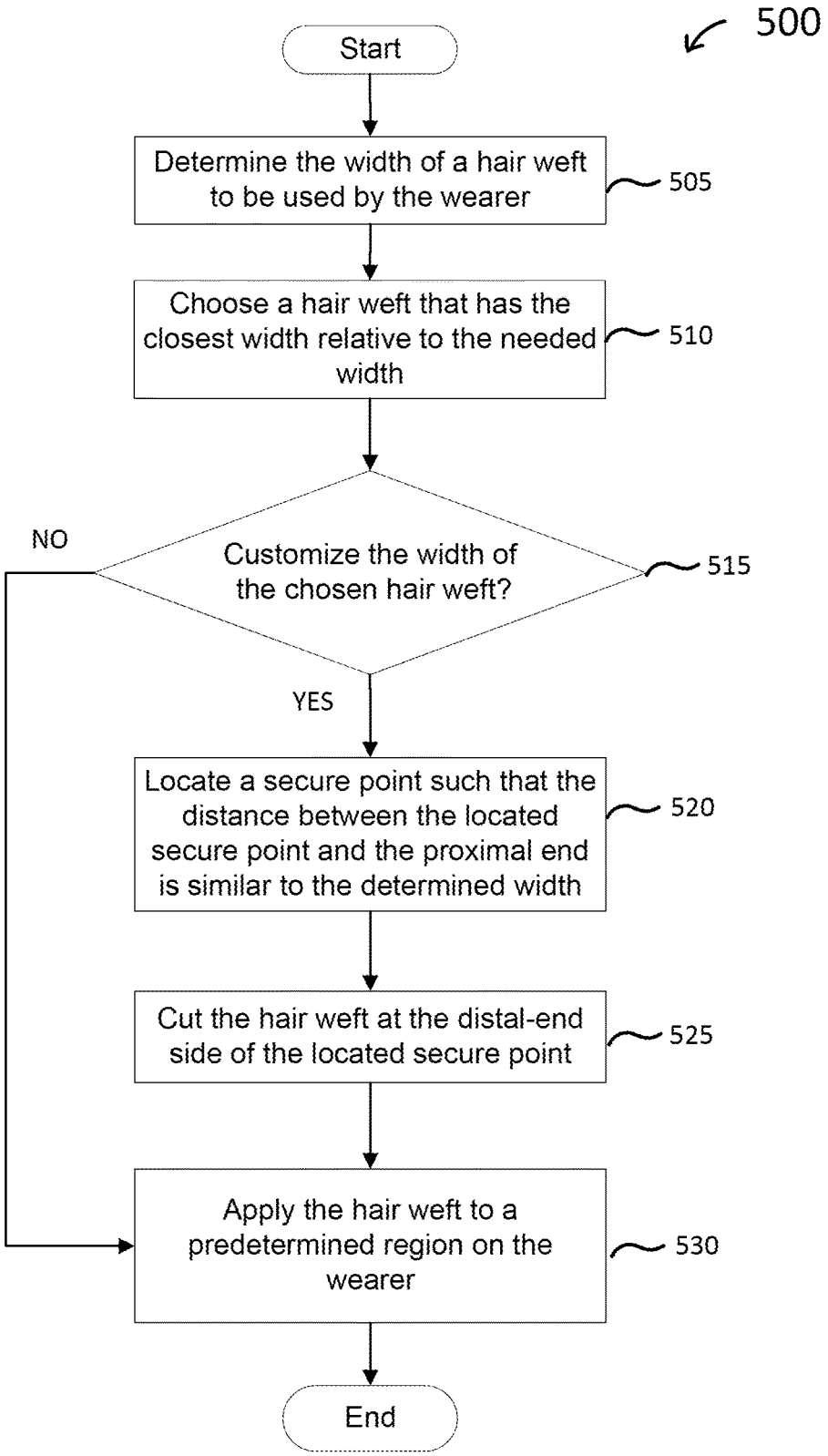
FIG. 5 depicts a flowchart of an exemplary method to customize the width of the hand-tied hair weft for a wearer.
Figure 6A:
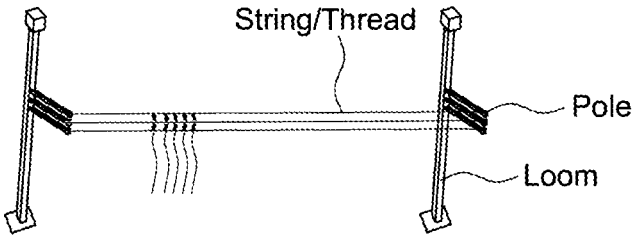
FIGS. 6A-6E depict corresponding steps of an exemplary method to form an exemplary secure point implemented in the exemplary hand-tied hair weft.
Figure 6B:
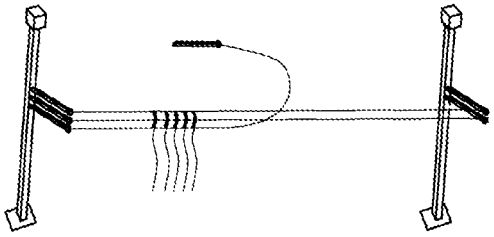
Figure 6C:
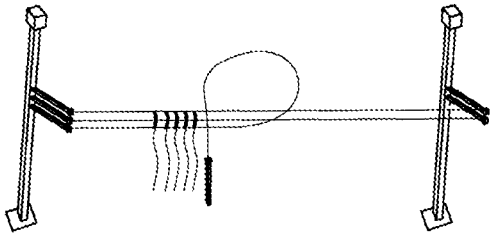
Figure 6D:
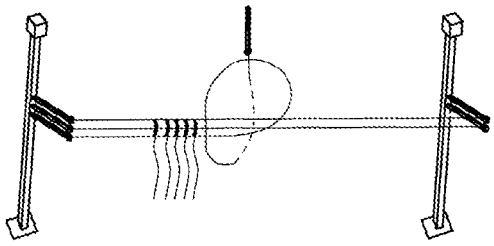
Figure 6E:
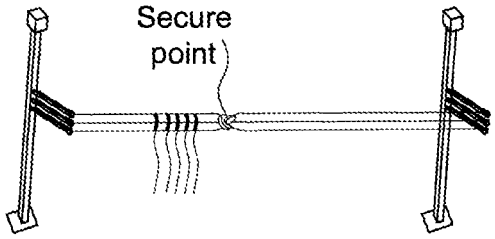

FIG. 5 depicts a flowchart of an exemplary method to customize the width of the hand-tied hair weft for a wearer. An exemplary method 500 to customize the width of the hand-tied hair weft, includes, at 505, determining the width (e.g., the distance between the distal end and the proximal end of the threads in the hand-tied hair weft) of a hand-tied hair weft to be used by the customer. The method 500 also includes, at 510, choosing a hand-tied hair weft that has the closet width relative to the needed width. For example, the width needed by the customer may be 3 inches, and current available widths of available hair wefts include, for example, 6 inches, 8 inches, and 14 inches. The hairstylist may then choose the 6-inch hand-tied hair weft. The method 500 also includes, at 515, determining whether to customize the width of the chosen hand-tied hair weft. If the width of the hand-tied hair weft is to be customized, then at 520, a secure point is located such that the distance between the located secure point and the proximal end is substantially equal (e.g., within a predetermined margin, for example, plus or minus 1 cm) to the determined width. In some embodiments, the hairstylist may also show the customer the potential width of the customized hand-tied hair weft and request the customer's approval. After the secure point the located, the method 500 also includes, at 525, cutting the chosen hand-tied hair weft at the distal-end side of the located secure point and take off the hair between the located secure point and the most adjected secure point from the distal-end side (e.g., shown in FIG. 1B). In some embodiments, when the hairstylist selects a hand-tied hair weft as shown in FIG. 1C, the hairstylist may cut between two sub secure points (e.g., 120*a*, 120*b*) of the located secure point (e.g., 120). The method 500 also includes, at 530, applying the hand-tied hair weft to a predetermined region of the wearer.

FIGS. 6A-6E depict corresponding steps of an exemplary method to form an exemplary secure point implemented in the exemplary hand-tied hair weft. In this depicted example, three threads are stretched between three pairs of poles, respectively. The three pairs of poles are detachably installed on a loom. After a number of hair strands are fixed in the three threads, a secure point may be made. In this depicted example, an exemplary method to make a knot is shown. For example, a worker may take off one pole from the loom and hold the pole and make a knot. The knot may include, by way of example but not limitation, a stopper knot. The stopper knot may include, by way of example but not limitation, an overhand knot, double overhand knot, figure-eight knot, Stevedore knot, and/or Ashley's stopper knot. In some embodiments, the knot may include a whipping knot. In some embodiments, the whipping knot may include a binding knot (e.g., constrictor knot). In some embodiments, the secure point may be made from one or more knots, alone or in combination.

Although various embodiments have been described with reference to the figures, other embodiments are possible. A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A hand-tied hair weft, comprising:

a plurality of filaments configured to provide a cortex and configured such that at least one of the plurality of filaments form a plurality of knots along a length of the cortex; and, at least two hair bundles fixed to the plurality of filaments, wherein each two adjacent hair bundles are separated by one or more of the plurality of knots, wherein a bundle length, comprising a predetermined distance along the cortex, of each of the at least two bundles varies according to a placement of the plurality of knots and a width of the hair weft.

2. The hand-tied hair weft of claim 1, wherein the two or more filaments comprise at least three filaments.

3. The hand-tied hair weft of claim 1, wherein the bundle lengths of each of the hair bundles varies proportionally to a distance of a corresponding hair bundle from one end of the cortex.

4. The hand-tied hair weft of claim 1, wherein the bundle lengths of each of the hair bundles varies according to the placement of the plurality of the knots along the cortex, wherein the placement of the plurality of the knots is inversely proportional to an absolute distance from a closest end of the cortex, such that the hair weft comprises a higher customization resolution at each end of the cortex.

5. The hand-tied hair weft of claim 1, wherein the bundle lengths increase as a distance of the hair bundles increases from one end of the cortex.

6. The hand-tied hair weft of claim 1, wherein the two or more filaments comprise strands.

7. The hand-tied hair weft of claim 1, wherein each of the at least two hair bundles comprise a number of strands of hair.

8. The hand-tied hair weft of claim 7, wherein the at least two hair bundles are individually suspended by tying the number of strands of hair to the cortex.

9. The hand-tied hair weft of claim 8, wherein each strand of the number of strands of hair is directly tied on the cortex.

10. The hand-tied hair weft of claim 1, wherein the cortex comprises a permanent textile dye.

11. The hand-tied hair weft of claim 1, wherein the width of the hair weft is customizable.

12. The hand-tied hair weft of claim 1, wherein the width of the hair weft comprises a distance between a distal and to a proximal end of the hair weft.

13. The hand-tied hair weft of claim 1, wherein the width of the hair weft is configured to be customized by cutting a similar number of hair bundles from each of a proximal end and a distal end of the hair weft.

14. A hand-tied hair weft, comprising:

a plurality of filaments configured to provide a cortex and configured such that at least one of the plurality of filaments form a plurality of knots along a length of the cortex;

at least two hair bundles fixed to the plurality of filaments; and, means for separating adjacent hair bundles, wherein a bundle length, comprising a predetermined distance along the cortex, of each of the at least two bundles varies according to a placement of the means for separating adjacent hair bundles, wherein the placement of the means for separating adjacent hair bundles is inversely proportional to an absolute distance from a closest end of the cortex, such that the hair weft comprises a higher customization resolution at each end of the cortex.

* * * * *